United States Patent [19]

Matsumoto et al.

[11] 4,158,401

[45] Jun. 19, 1979

[54] DEVICE FOR CONTROLLING A PROPAGATION DIRECTION OF NOISE

[75] Inventors: Masayasu Matsumoto, Zushi; Kazuyoshi Iida, Yokohama; Yoshikazu Kondo, Yokohama; Keiichiro Mizuno, Yokohama; Sadao Nomoto, Yokohama; Noriaki Murayama, Kawasaki; Kei Watanabe; Tomonori Katayama, both of Yokohama, all of Japan

[73] Assignee: Bridgestone Tire Company Limited, Tokyo, Japan

[21] Appl. No.: 703,985

[22] Filed: Jul. 9, 1976

[30] Foreign Application Priority Data

Jul. 11, 1975 [JP] Japan ..... 50-84412
Jul. 23, 1975 [JP] Japan ..... 50-101991[U]

[51] Int. Cl.[2] ..... G10K 11/00; E04H 17/00

[52] U.S. Cl. ..... 181/210; 181/286; 181/288; 181/292; 104/124; 105/452

[58] Field of Search ..... 181/206, 210, 284, 285, 181/286, 290, 292, 293, 224, 288; 105/452; 104/124; 256/13.1, 73

[56] References Cited

U.S. PATENT DOCUMENTS 3,113,634 12/1963 Watters ..... 181/224
3,887,031 6/1975 Wirt ..... 181/292
3,913,702 10/1975 Wirt et al. ..... 181/288
4,069,768 1/1978 Matsumoto et al. ..... 105/452

*Primary Examiner*—L. T. Hix
*Assistant Examiner*—Benjamin R. Fuller
*Attorney, Agent, or Firm*—Sughrue, Rothwell, Mion, Zinn and Macpeak

[57] ABSTRACT

A device for controlling a propagation direction of noise, which is preferably associated with a sound insulating wall to significantly improve its sound reducing effect of alleviating noise emitted from a noise source such as a railroad, highway and the like on which an electric car and automobiles run. The device comprises a hollow structural body composed of a plurality of elongated vertical hollow passages arranged at right angles to a substrate and spaced apart from each other by means of partition walls. The upper noise inlet side surface of the hollow passages face a propagation direction of noise emitted from the noise source and serve to refract and lag in phase the noise passed therethrough, thereby producing a sound reducing region located intermediate between a direct sound propagation and the refracted sound propagation. In one embodiment, a pair of hollow structural bodies are arranged in opposition to each other to form an arch type device. In another embodiment, the hollow structural body may be provided at its noise inlet or outlet side surface with an extension of the hollow passages.

11 Claims, 37 Drawing Figures

DEVICE FOR CONTROLLING A PROPAGATION DIRECTION OF NOISE

This invention relates to devices for controlling a propagation direction of noise and more particularly to a device for controlling a propagation direction of noise, which may be used in connection with a sound insulating wall and the like to significantly improve its sound reducing effect of alleviating noise emitted from a noise source such as a railroad, highway and the like on which an electric car and automobiles run.

As means for reducing noise, it has been the common practice to provide a barrier such as a sound insulating wall and the like and arrange it between a noise source and a noise receiving region for the purpose of intercepting propagation of the noise or provide a barrier constructed to completely surround a noise source and shield it.

However, it is known that such a barrier is passed over by the noise and hence is limited in its sound insulating effect. Also, such a barrier requires other means such as a heat dissipation device, a ventilation device and the like and hence becomes complex in construction and eventually is difficult to effectuate.

The above mentioned problem has been encountered with all means for insulating noise produced from an electric car run on railroad, automobiles run on roads and various machines.

In order to eliminate such problem, this invention relates to a device for controlling a propagation direction of noise, which comprises a hollow structural body composed of a plurality of elongated hollow passages inclined downwardly from its noise inlet side surface with respect to a substrate and arranged between a noise source and a noise receiving region. It can refract downwardly a portion of noise emitted from the noise source when passed through the elongated hollow passages which causes part of the noise to make frictional contact with the hollow passage wall so as to lag in phase of sound propagation thereof with respect to a direct sound propagation emitted from the noise source and passed over the upper edge of the hollow structural body. The refracted sound propagation interferes with the direct sound propagation to produce a sound reducing region located intermediate between the direct sound propagation and the refraction sound propagation.

An object of the invention, is to provide an improved device for controlling a propagation direction of noise, which is simple in construction and can eliminate the above mentioned problem.

Another object of the invention is to provide an improved device for controlling a propagation direction of noise, which not only can control the propagation direction of noise but also can produce a region where noise is significantly reduced.

A feature of the invention is the provision of an improved device for controlling a propagation direction of noise, comprising a hollow structural body composed of a plurality of elongated hollow passages, said hollow passages being arranged at right angles to a substrate, two adjacent hollow passages being different in length and at least a part of said hollow passages being distant apart from and located above the substrate. A part of noise emitted and propagated from a noise source is refracted and lagged in phase when passed through said vertical hollow passages and the refracted sound is interfered with a direct sound propagation passing over the upper edge of the vertical hollow passages to produce a sound reducing region intermediate between the direct sound propagation and the refracted sound propagation.

A principle of the device according to the invention will now be described with reference to FIGS. 1 to 4 which show sketches of photographs illustrating sound distributions produced in the absence and presence of the device according to the invention.

In FIG. 1 is shown a sketch of photograph illustrating a distribution of ⅓ octave band noise having a center frequency of 2,000 Hz and emitted from a noise source 1 in the absence of the device according to the invention.

In FIG. 2 is shown a sketch of photograph illustrating a distribution of ⅓ octave band noise having a center frequency of 2,000 Hz and emitted from the same noise source 1 in the presence of the device 2 according to the invention.

As seen from FIG. 2, the presence of the device 2 according to the invention causes a part of noise emitted from the noise source 1 and passed through a plurality of elongated vertical hollow passages 3 of the device 2 to refract vertically downwardly with respect to a direct propagation sound B passing over the upper edge of the device 2 without no refraction to produce a region C which is located intermediate between the direct propagation sound B and a refracted propagation sound A and which can significantly reduce sound.

In FIG. 3 is shown a sketch of photograph illustrating a distribution of a pure tone having a frequency of 2,000 Hz and emitted from a sound source 1 subjected to sine wave oscillations in the absence of the device according to the invention.

In FIG. 4 is shown a sketch of photograph illustrating a distribution of a pure tone having a frequency of 2,000 Hz and emitted from the same sound source 1 subjected to the sine wave oscillations in the presence of the device 2 according to the invention.

As seen from FIG. 3, the pure tone emitted from the sound source 1 is propagated in a spherical wave with no phase lag. The presence of the device 2 according to the invention, however, causes a sound wave passed through a plurality of elongated vertical hollow passages 3 and propagated in a plane wave to refract vertically downwardly and lag in phase with respect to a direct propagation sound B passing over the upper edge of the device 2 and propagated in a spherical wave, and as a result, a wave front at a region C located intermediate between the direct sound propagation B and a refracted sound propagation A becomes discontinuous as shown in FIG. 4. This discontinuous wave front at the region C shows that there is produced a destructive interference phenomenon. As a result, the sound reducing region C shown in FIG. 2 is produced. The above explanation is why the sound reducing region C shown in FIG. 2 is produced.

The dimension of the sound reducing region C caused by the interference of the refracted sound propagation A with the direct sound propagation B is determined by the size of the device 2 according to the invention, the difference in length L between adjacent elongated vertical hollow passages 3, 3 of the device 2 and the position of the noise source 1.

That is, the upper boundary line of the sound reducing region C is aligned with a straight line connecting the noise source 1 to the upper edge of the device 2, while the lower boundary line of the sound reducing region C becomes more largely inclined as the difference in length L between adjacent vertically extending hollow passages 3, 3 of the device becomes more enlarged.

The invention will now be described in greater detail with reference to the accompanying drawings, wherein.

Figure 11A:
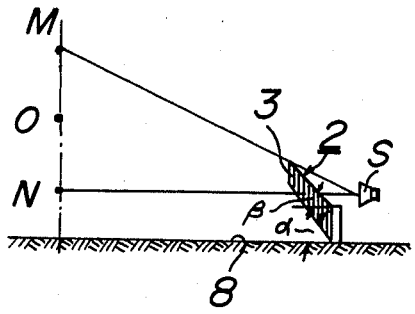
Figure 11B:
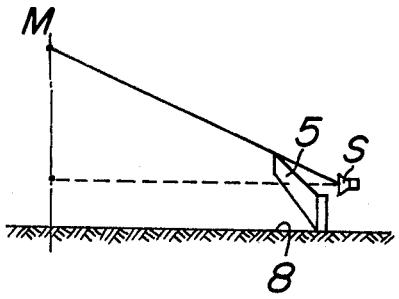
Figure 12:
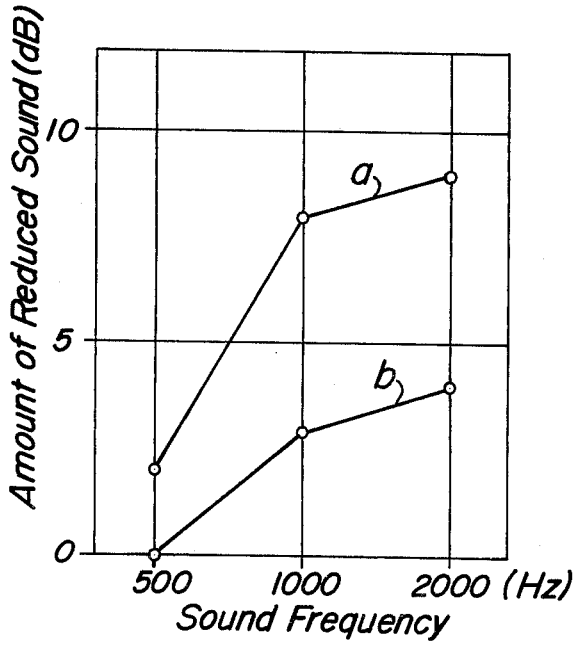

FIGS. 11*a* and 11*b* are diagrammatic views illustrating experimental tests;

FIG. 12 is a graph illustrating the result yielded from the experimental tests illustrated in FIG. 11*b;*

Figure 13:
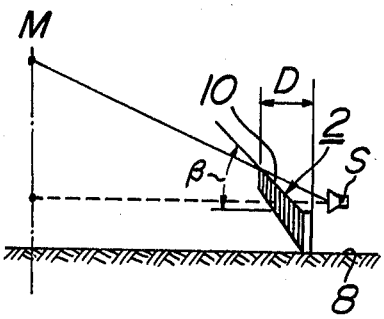
Figure 14:
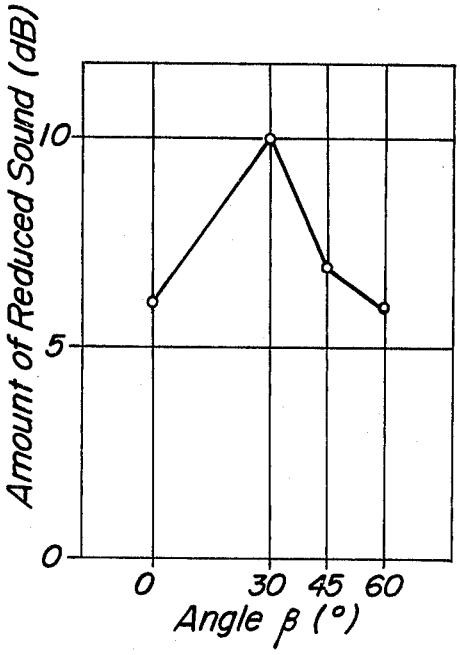
Figure 15:
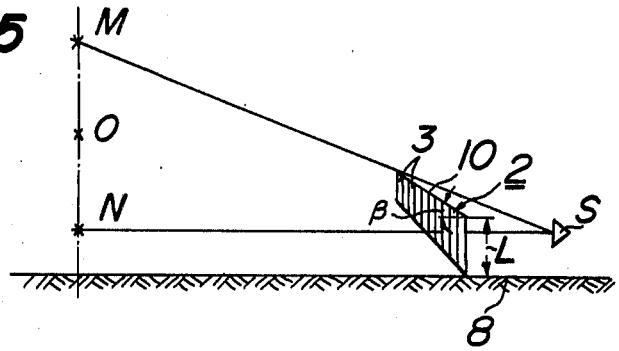
Figure 16:
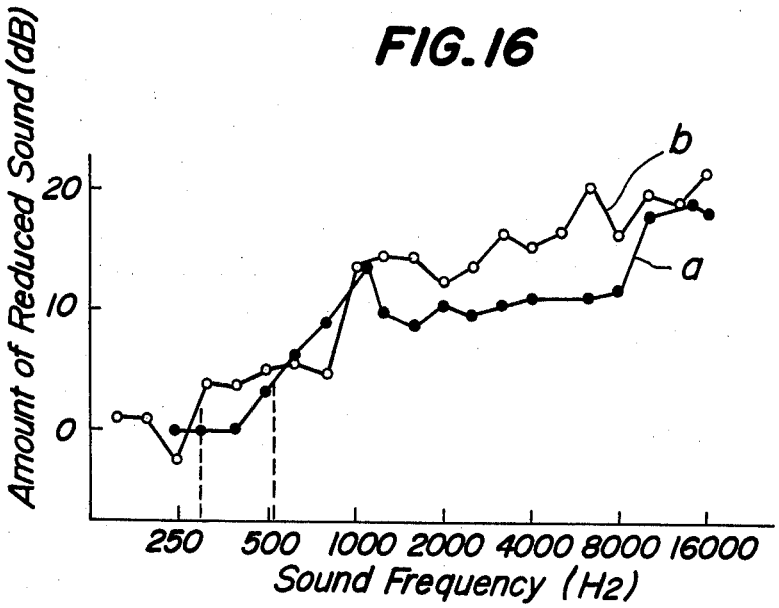
Figure 17:
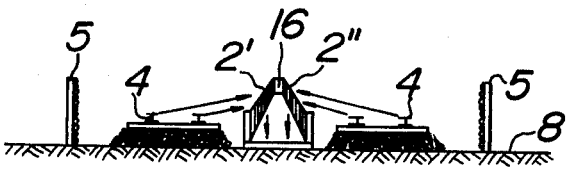
Figure 18:
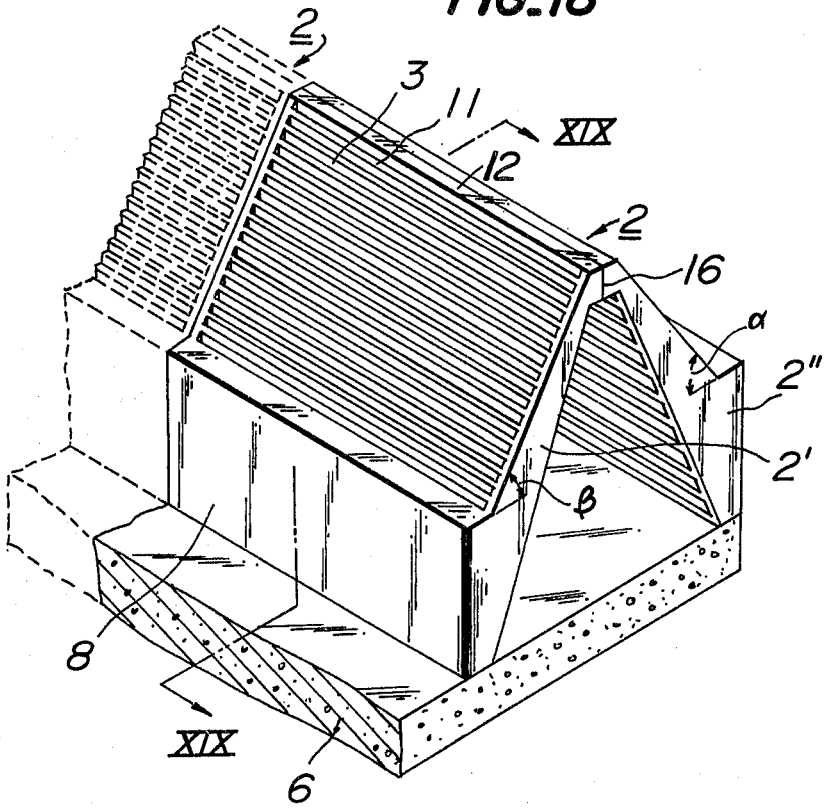
Figure 19:
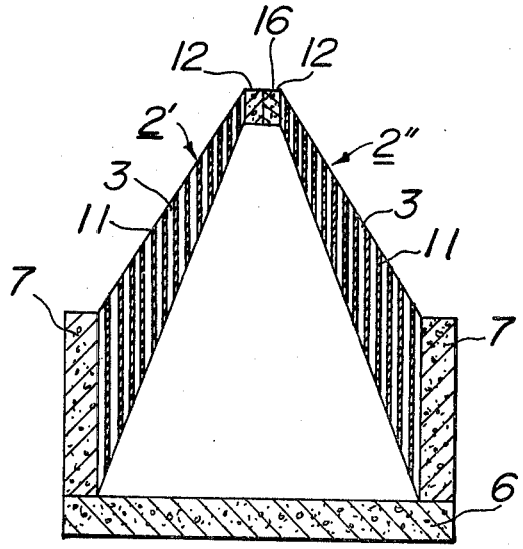
Figure 20:
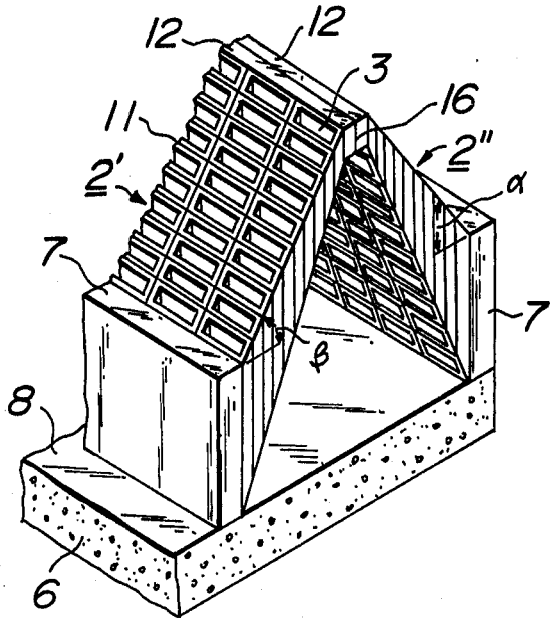
Figure 21:
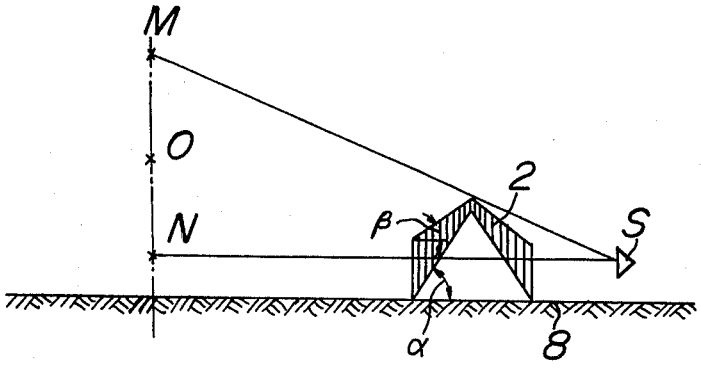
Figure 26A:
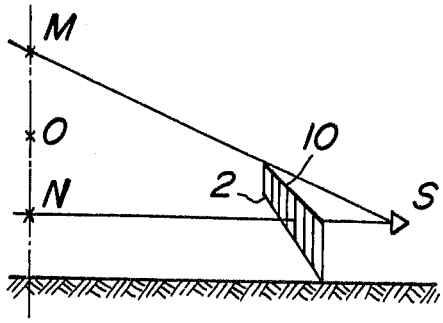
Figure 26B:
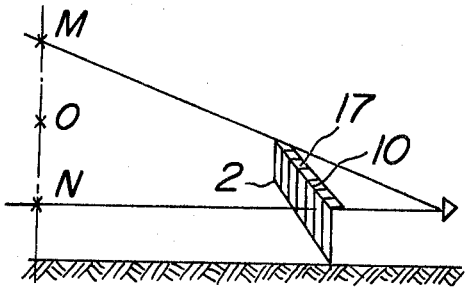
Figure 27:
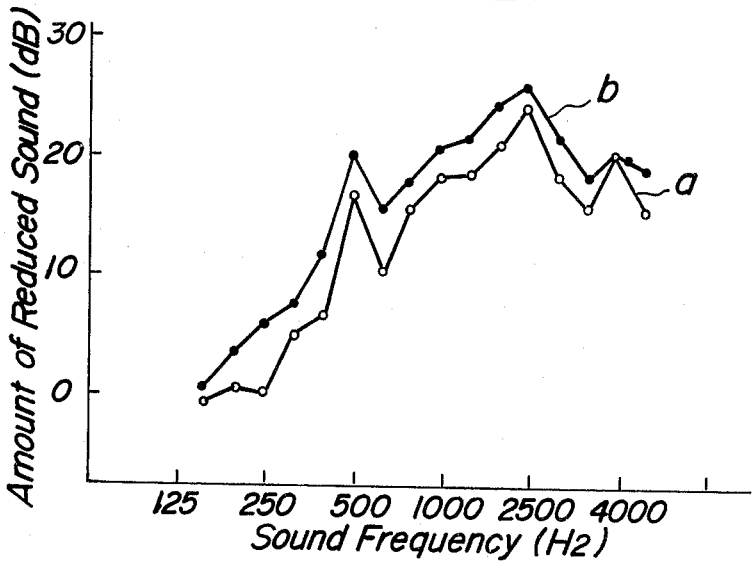

FIG. 13 is a diagrammatic view illustrating another experimental test;

FIG. 14 is a graph illustrating the result yielded from the experimental test illustrated in FIG. 13;

FIG. 15 is a diagrammatic view illustrating a further experimental test;

FIG. 16 is a graph illustrating the result yielded from the experimental test illustrated in FIG. 15;

FIG. 17 is a front elevational view showing an arch type device according to the invention in section which is arranged between two railroads so as to reduce noise produced by an electric car run on rails;

FIG. 18 is a perspective view of one embodiment of the arch type device shown in FIG. 17;

FIG. 19 is a cross sectional view taken on line XIX—XIX of FIG. 18;

FIG. 20 is a perspective view of another embodiment of the arch type device according to the invention;

FIG. 21 is a diagrammatic view illustrating an experimental test on the arch type device according to the invention;

FIGS. 22*a* to 25*c* are diagrammatic views showing various embodiments of an extension of hollow passages of the device according to the invention;

FIGS. 26*a* and 26*b* are diagrammatic views illustrating experimental tests effected on the device according to the invention with and without the extension of the hollow passages; and FIG. 27 is a graph illustrating the result yielded from the experimental tests illustrated in FIGS. 26*a* and 26*b*.

Figure 1:
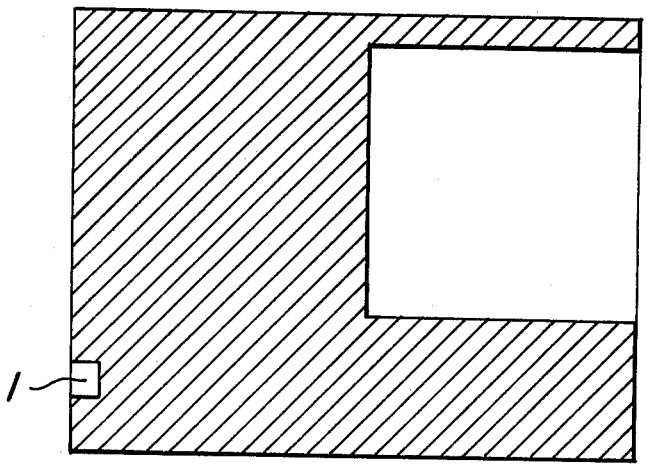
FIGS. 1 to 4 show sketches of photographs illustrating a principle of the device according to the invention.
Figure 2:
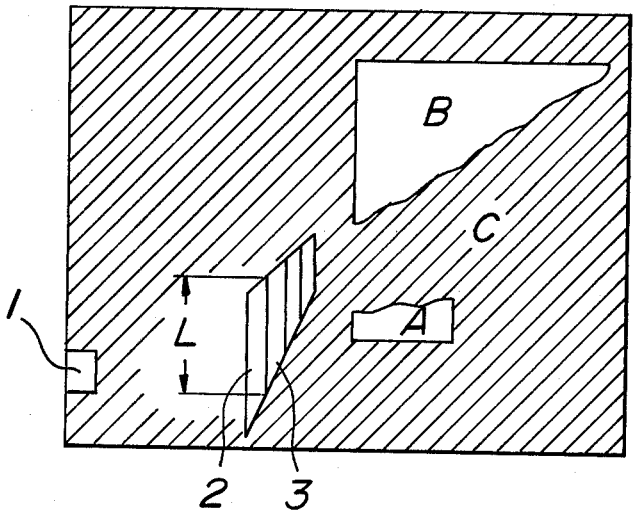
Figure 3:
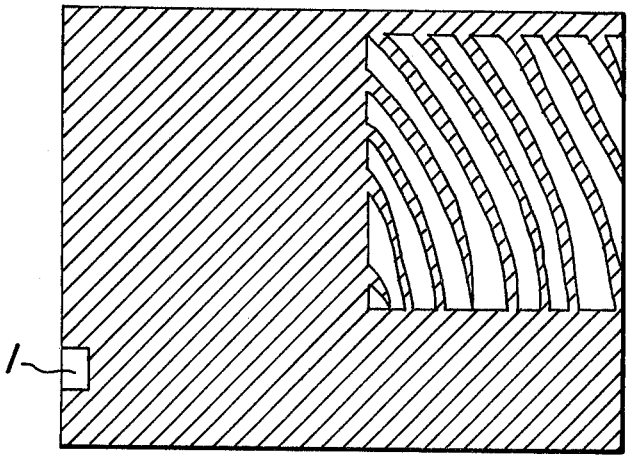
Figure 4:
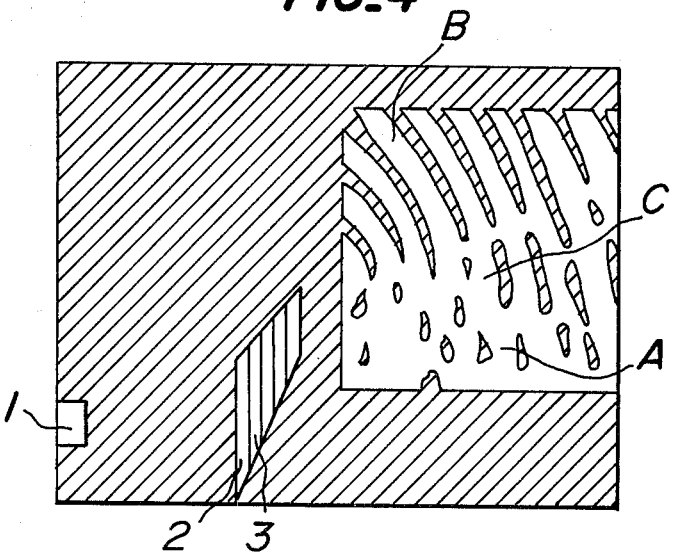
Figure 5:
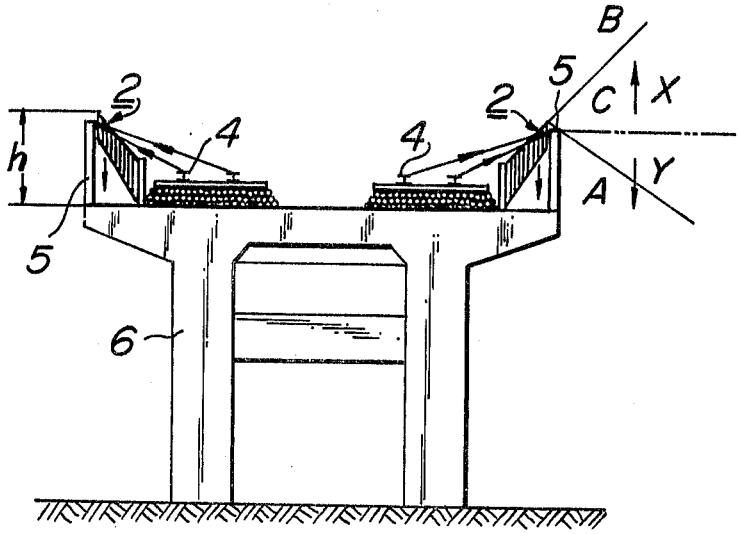
FIG. 5 is a front elevational view showing the device according to the invention in section which is applied to an elevated railroad so as to reduce noise produced by an electric car run on rails.

Referring now to FIG. 5 showing the device according to the invention applied so as to reduce noise produced from a contact portion of rails 4 with wheels (not shown) of an electric car. In FIG. 5, reference numeral 5 designates sound insulating walls arranged at both sides of a railway overhead structure 6 and opposed to each other. The sound insulating wall 5 is constructed to absorb or intercept noise generated from the noise source which, in the present embodiment, is a contact portion of rails 4 with wheels of an electric car. In this case, the noise passed over the upper edge of the sound insulating wall 5 is freely propagated into a region X, so that substantially no sound reducing effect is obtained therein. A part of the noise passed over the upper edge of the sound insulating wall 5 is refracted to a region Y located in the rear of the sound insulating wall 5, so that no excellent sound reducing effect is expected therein. Experimental tests have demonstrated that such sound reducing effect in the region Y is at most 20 dB.

In accordance with the invention, between the noise source 4 and the sound insulating wall 5 is arranged a device 2 according to the invention which is constructed and arranged such that noise produced from the noise source 4 is concentrically propagated toward the sound insulating wall 5 and at the same time that part of the noise which passed over the upper edge of the sound insulating wall 5 is considerably reduced. For this purpose, the device 2 according to the invention is constructed and arranged such that the upper edge of the sound insulating wall 5 is located within the interference sound reducing region C, that is, the height h is made at least equal to a line connecting the noise source 4 to the front upper edge of the sound insulating wall 5 and that the part of the noise which might be refracted into the region Y is intercepted by the sound insulating wall 5.

Figure 6:
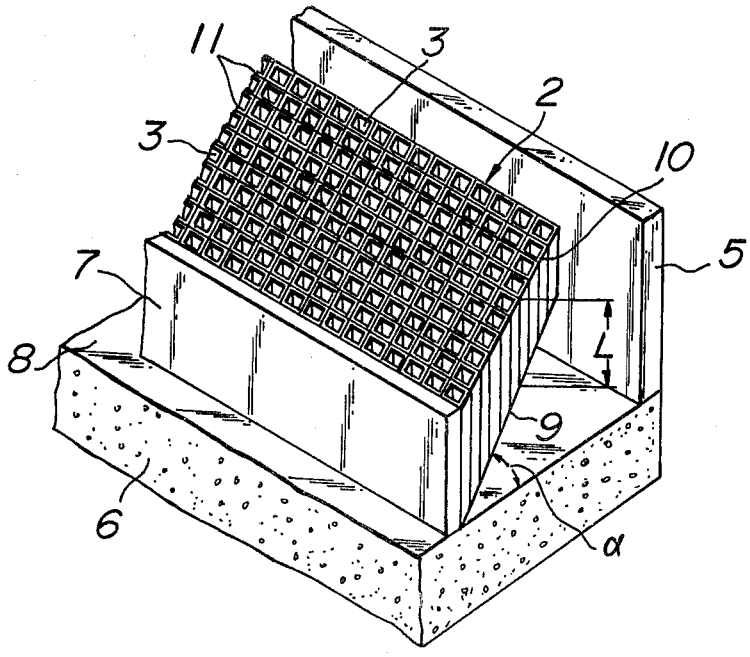
FIG. 6 is a perspective view of one embodiment of the device according to the invention which comprises a hollow structural body composed of a plurality of square honeycomb-shaped elongated vertical hollow passages.

In FIG. 6 is shown one embodiment of the device 2 according to the invention which comprises a supporting member 7 arranged at right angles to a substrate 8 which is an upper surface of the railway overhead structure 6 and secured at its lower end to the substrate 8 and a hollow structural body composed of a plurality of honeycomb-shaped square elongated vertical hollow passages 3 arranged at right angles to the substrate 8. Between the lower noise outlet side surface 9 of the hollow passages 3 and the substrate 8 is formed a space. In the present embodiment, the lower noise outlet side surface 9 of the hollow passages 3 is inclined from the substrate 8 by an angle $\alpha$ such that the space between the lower noise outlet side surface 9 of the hollow passages 3 and the substrate 8 is gradually enlarged from the supporting member 7 to the sound insulating wall 5. The noise generated from the noise source 1 arrives at the upper noise inlet side surface 10 of the vertical hollow passages 3 and is propagated downwardly therethrough toward the substrate 8.

The upper noise inlet side surface 10 of the hollow passages 3 become higher as it is distant apart from the supporting member 7 and approaches to the sound insulating wall 5. In other words, the upper noise inlet side surface 10 of the hollow passages 3 is inclined upwardly from the propagation direction of the noise or the substrate 8 by a suitable angle $\beta$. If this angle $\beta$ is different from the angle $\alpha$ formed between the lower noise outlet side surface 9 of the hollow passages 3 and the substrate 8, two adjacent elongated vertical hollow passages 3, 3 become different in length L. As a result, these elongated vertical hollow passages 3, 3 cause noise passed therethrough to refract and lag in phase with respect to the direct sound propagation passed over the upper edge of the device 2, thereby improving the effect of controlling the propagation direction of the noise. Experimental tests have yielded good results when the angle $\beta$ is defined to 15° to 50°, preferably 30°.

It is preferable that partition walls 11 defining the hollow passages 3, 3 are formed of a material having an excellent water resistant property and weather resistant property. Such material is selected from the group consisting of a metal material such as stainless steel, inorganic material which is light in weight and synthetic material.

Figure 7:
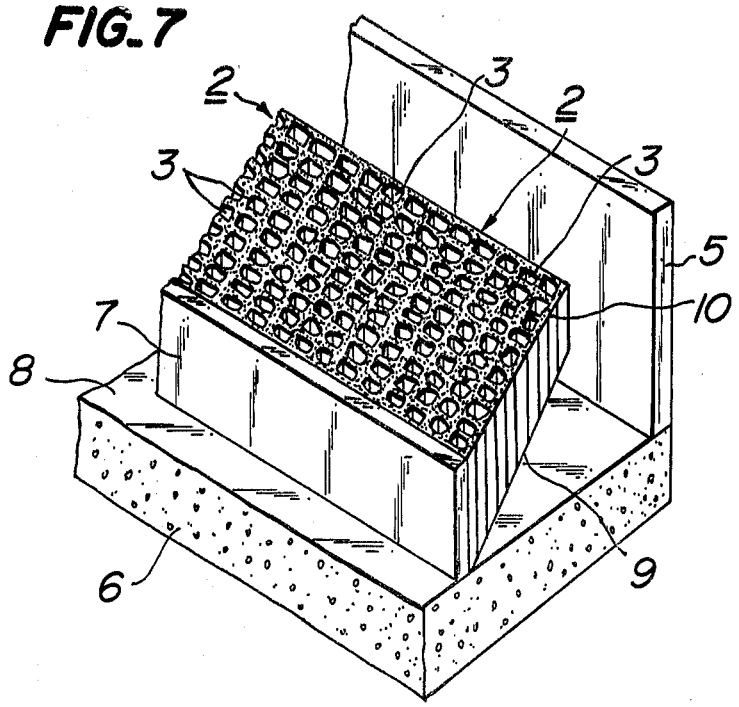
FIG. 7 is a perspective view showing a modified embodiment of the device shown in FIG. 6.

In FIG. 7 is shown a modified form of the device 2 shown in FIG. 6. In the present embodiment, a plurality of elongated vertical hollow passages 3, 3 are of any cross sectional configurations. Such elongate vertical hollow passages 3, 3 may be arranged at random.

Figure 8:
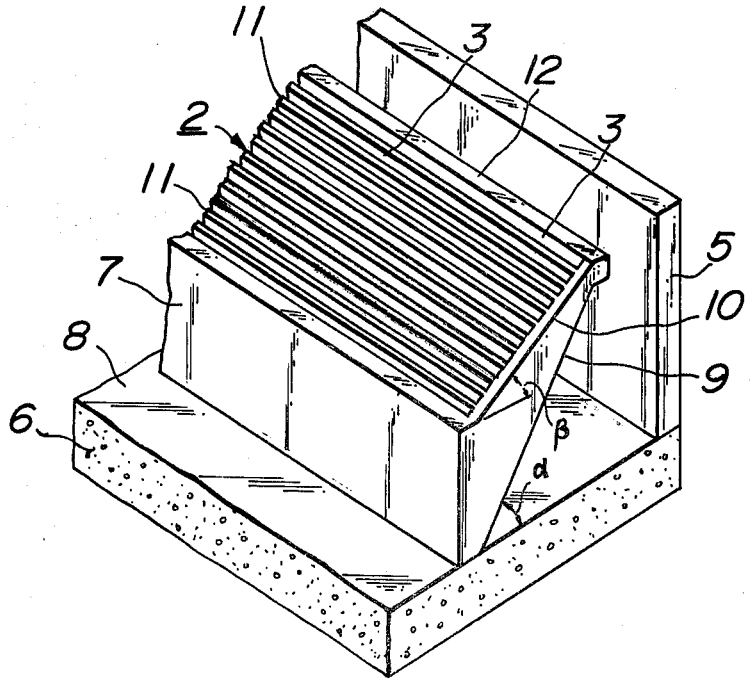
FIG. 8 is a perspective view of another embodiment of the device according to the invention which comprises a hollow structural body composed of a plurality of elongated vertical hollow passages made integral with a supporting member.

In FIG. 8 is shown another embodiment of the device 2 according to the invention. In the present embodiment, the vertical hollow passages 3, 3 are defined by parallel partition walls 11, 11 which are equally spaced apart from each other. Both the supporting member 7 and the partition walls 11, 11 are formed of inorganic material and molded into one integral body.

Similar to the embodiment shown in FIG. 6, the lower noise outlet side surface 9 of the hollow passages 3 is inclined from the substrate 8 by a suitable angle $\alpha$ so as to form a space between the hollow passages 3 and the substrate 8 and gradually enlarged from the supporting member 7 to the sound insulating wall 5. The elongate vertical hollow passages 3 cause noise passed therethrough to refract and lag in phase with respect to the direct sound propagation passed over the upper edge of the hollow passages 3, thereby improving the effect of controlling the propagation direction of the noise. In FIG. 8, reference numeral 12 designates a flange made integral with the upper edge of the hollow passages 3. The flange 12 serves to dispose the upper edge of the device 2 on a suitable support (not shown) so as to stabilize the device 2.

Figure 9:
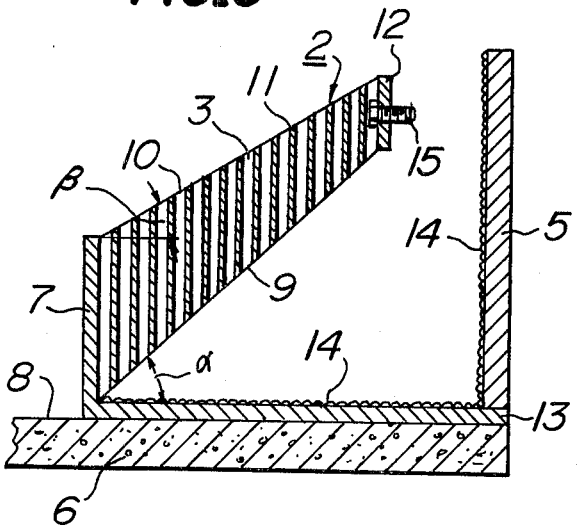
FIG. 9 is a cross sectional view of a further embodiment of the device according to the invention which comprises a hollow structural body composed of a plurality of elongated vertical hollow passages separated from and secured to a supporting member.

In FIG. 9 is shown a further embodiment of the device 2 according to the invention. In the present embodiment, similar to the embodiment shown in FIG. 8, the hollow passages 3 are defined by vertically extending parallel partition walls 11 which are equally spaced apart from each other. In the present embodiment, the supporting member 7 is provided at its lower end with a base plate 13 extending in parallel with the substrate 8 and made integral with the supporting wall 7. The sound insulating wall 5 is arranged at the free end of the base plate 13 and opposed to the supporting member 7. Both the sound insulating wall 5 and the base plate 13 are provided at their inside surfaces with a sound absorbing material 14 and the device 2 is mounted on the base plate 13 by means of the supporting member 7. In addition, the device 2 is provided at its upper free end with a fixture such as a bolt and nut 15 which can secure the upper free end of the device 2 to any suitable support (not shown) so as to stabilize it.

Figure 10:
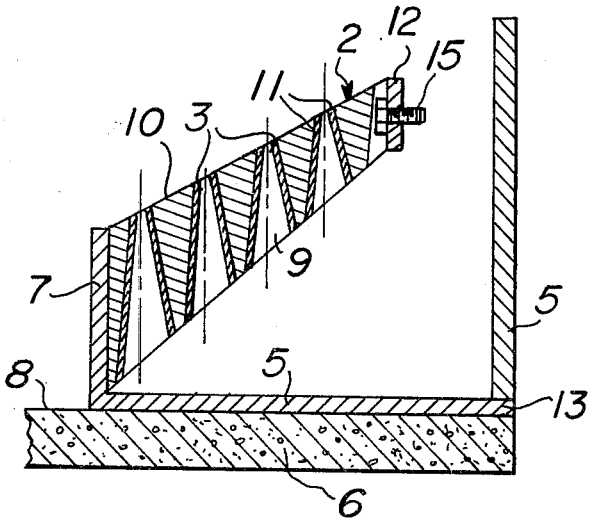
FIG. 10 is a cross sectional view of a modified form of the device shown in FIG. 9.

In FIG. 10 is shown a modified form of the device shown in FIG. 9. In the present embodiment, each cross sectional area of the hollow passages 3 is enlarged from its upper noise inlet side surface 10 toward its lower noise outlet side surface 9.

In FIG. 11*a*, a device 2 according to the invention ($\alpha$=65°, $\beta$=45°) was disposed on a substrate 8 and in front of the device 2 was arranged a speaker S from which was delivered a band noise having a center frequency of 1,000 Hz. The sound pressure level in dB of respective points M, N and O was measured.

Next, the device 2 was removed and the sound pressure level in dB of the above points M, N and O was measured to obtain the amount of reduced sound at each point. The result obtained is shown in the following Table 1.

Table 1

| Measuring point | Absence of control device | Presence of control device | Amount of reduced sound |
|---|---|---|---|
| M | 65 | 57 | −8 |
| O | 65 | 55 | −10 |
| N | 65 | 64 | −1 |

In the above Table, the term the amount of reduced sound shall be understood to mean a difference between a sound pressure level measured in the presence of the control device 2 and a sound pressure level measured in the absence of the control device 2.

In FIG. 11*a*, the point M is located on an extension of a line connecting the speaker S to the upper edge of the device 2, the point N is a crossing point of a line drawn from the point M at right angles to the substrate 8 with an extension of an axial line of the speaker S and the point O is a midpoint between the points M and N.

As seen from the above experimental test result, at the point N which is the nearest to the substrate 8 the sound reducing effect can not be obtained, while at the points M and O which are distant apart from the substrate 8 the sound reducing effect of 8 to 10 dB can be obtained. This shows that a considerably large amount of noise emitted from the noise source s is refracted into the vertical hollow passages 3 of the device 2 and lagged in phase with respect to the direct propagation sound passed over the upper edge of the device 2 to produce a sound reducing region located between the direct sound propagation and the refraction sound propagation, thereby reducing the amount of noise at the upper points M, O.

The amount of reduced sound in dB of a band noise having a center frequency of 1,000 Hz emitted from the speaker S and passed through the device 2 was measured at the point M in the same manner as in the above experimental test shown in FIG. 11*a*.

Next, the amount of reduced sound in dB of the same band noise emitted from the speaker S toward a conventional sound insulating wall 5 which is the same in configuration as the device 2 shown in FIG. 11*a* was measured at the point M as shown in FIG. 11*b*.

The result obtained from both the experimental tests is shown in curves a and b in FIG. 12. The curve a shows the result from the first experimental test effected in the presence of the device 2 at the point M, while the curve b shows the result from the second experimental test effected in the presence of the conventional sound insulating wall 5 as shown in FIG. 11*b*.

As seen from FIG. 12, the presence of the device 2 according to the invention ensures a significantly large sound reducing effect if compared with that of the conventional sound insulating wall 5.

Various kinds of control devices 2 having upper noise inlet side surfaces 10 inclined from the substrate 8 by different angles $\beta$ are arranged on the substrate 8 as shown in FIG. 13. The longitudinal length D of an upper noise inlet side surfaces 10 of all of these devices 2 is made constant. Then, the amount of reduced sound in dB of a band noise having a center frequency of 1,000

Hz emitted from the speaker S and passed through these devices 2 was measured at the point M in the same manner as in the experimental test illustrated with FIG. 11*a*.

The result obtained from these experimental tests is shown as a curve in FIG. 14. As seen from FIG. 14, if the angle $\beta$ is designed to 15° to 50°, the sound reducing effect becomes increased. Particularly, if the angle $\beta$ is designed to about 30°, the optimum sound reducing effect is obtained.

The relation between the maximum length L of the elongate vertical hollow passages 3 of the device 2 and the sound frequency will now be described with reference to FIGS. 15 and 16.

In FIG. 15, two test devices 2, 2 according to the invention are arranged between a speaker S and a sound receiving point O which is a midpoint between a point M located on an extension of a line connecting the speaker S to the upper edge of the device 2 and a point N located on an extension of an axial line of the speaker S. The upper noise inlet side surface 10 of each test device is inclined from the substrate 5 by $\beta=45°$. The maximum length L of the elongated vertical hollow passages of one of the two test devices 2 is made 330 mm and that of the other test device is made 600 mm. The speaker S was designed to emit the noise and the amount of reduced sound obtained by the two test devices 2 was measured at the point O. The results of experimental tests are shown by two curves a and b in FIG. 16. The curve a denoted by a symbol . shows that if the maximum length L of the elongated vertical hollow passages 3 is defined to 330 mm, an increase of the amount of reduced sound is started from the minimum frequency of 500 Hz (calculation value is 515 Hz) and the curve b denoted by a symbol o shows that if the maximum length L of the elongated vertical hollow passages 3 is defined to 600 mm, an increase of the amount of reduced sound is started from the minimum frequency of 280 Hz (calculation value is 283 Hz).

This shows that if the maximum length L of the elongated vertical hollow passages 3 of the device 2 is defined to a length which is longer than ½ times the wave length $\lambda$ of the minimum frequency f in that frequency range of noise emitted from a noise source which is to be controlled, it is possible to significantly reduce the noise.

In FIG. 17 is shown another use of the device 2 according to the invention in which the device 2 is arranged at a position intermediate between the two opposed rails 4, 4. In such a case, it is preferable that the device 2 is composed of a pair of holiow structural bodies 2', 2" arranged in opposition to each other to form an arch type device with their upper edges 16 abutted against with each other as shown in FIG. 17.

FIGS. 18 and 19 show in greater detail one embodiment of the arch type device 2 shown in FIG. 17. In the present embodiment, the device 2 is composed of a pair of hollow structural bodies 2', 2" shown in FIG. 8 and arranged in opposition to each other. Both the hollow structural bodies 2', 2" are provided at their upper edges with flanges 12 which are abutted at their opposed surfaces 16 against with each other to form an arch type device 2 as a whole. FIG. 19 shows these details in a section on line XIX—XIX of FIG. 18.

In FIG. 20 is shown in greater detail another embodiment of the arch type device. In the present embodiment, the device 2 is composed of a pair of hollow structural bodies 2', 2" shown in FIG. 6 arranged in opposition to each other. Both the devices 2', 2" are also provided at their upper edges with flanges 12 which are abutted against at their opposed surfaces 16 with each other to form an arch type device as a whole. In the present embodiment, both the hollow structural bodies 2'; 2" are composed of a plurality of honeycomb-shaped rectangular elongated vertical hollow passages 3 arranged at right angles to the substrate 6.

In order to ascertain the sound reducing effect of the arch type device, an arch type device 2 ($\alpha=65°$ and $\beta=45°$) shown in FIG. 21 was arranged between a speaker S and sound receiving points M, N and O. The point M is located on an extension of a line connecting the speaker S to the upper edge of the device 2 and the point O is a midpoint between the point M and a point N located on an extension of an axial line of the speaker S. A band noise having a center frequency of 1,000 Hz was emitted from the speaker S and the amount of reduced sound was measured at the points M, N and O. The result obtained is shown in the following Table 2.

Table 2

| Measuring point | Absence of control device | Presence of control device | Amount of reduced sound (dB) |
|---|---|---|---|
| M | 68 | 58 | −10 |
| O | 68 | 43 | −15 |
| N | 68 | 43 | −15 |

As seen from the above Table 2, the presence of the arch type device 2 according to the invention ensures a significantly large sound reducing effect at the points N and O located in the rear of the device 2.

The inventors have found out that the sound reducing effect of the device 2 according to the invention may be improved if the device 2 is provided at its noise inlet or outlet side surface with an extension 17 having a plurality of hollow passages 3' communicating with corresponding hollow passages 3 of the device 2. The extension 17 may be made integral with or separated from the device 2.

Figure 22A:
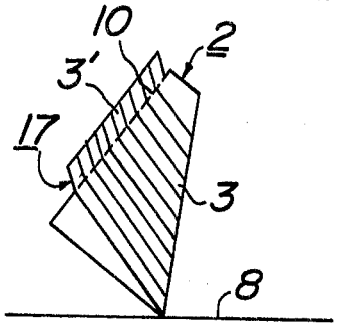

FIG. 22*a* shows one embodiment of such extension 17 which is integral with the upper noise inlet side surface 10 of the downwardly extending hollow passages 3 of a prior art device 2. Such a prior art device is described in U.S. Pat. No. 4,069,768. As shown in FIG. 22*a*, it comprises a hollow structural body composed of a plurality of elongate hollow passages 3 inclined downwardly from its noise inlet side surface 10 with respect to a substrate 8 and arranged between a noise source and receiving region. The hollow passages 3' of the extension 17 are inclined from the substrate 8 by an angle which is different from that of the hollow passages 3 of the device 2.

Figure 22B:
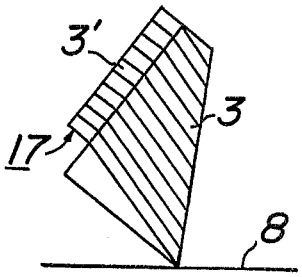

FIG. 22*b* shows another embodiment of the extension 17 which is separated from the prior art device shown in FIG. 22*a* and secured thereto. The inclined angle of the hollow passages 3' of the extension 17 is also made different from that of the inclined angle of the hollow passages 3 of the device 2.

FIGS. 23*a* to 23*e* show various embodiments of the extension 17 which is provided for the device 2 according to the invention.

Figure 23A:
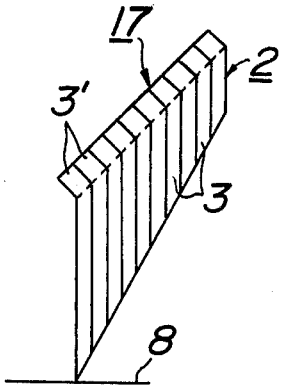
Figure 23B:
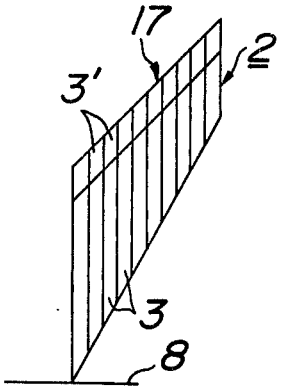

In the embodiment shown in FIG. 23*a*, the extension 17 is made integral with the device 2 and the hollow passages 3' thereof are inclined from the substrate 8 by an angle which is different from that of the hollow passages 3 of the control device 2.

In modified embodiments shown in FIGS. 23*b* to 23*e*, the extensions 17 are separated from the devices 2 and secured thereto. In the embodiment shown in FIG. 23*b*, all of the hollow passages 3' of the extension 17 communicate with corresponding hollow passages 3 of the device 2. In the embodiments shown in FIGS. 23*c* and 23*d*, the device 2 is provided at one part of its upper noise inlet side surface 10 with an extension 17.

Figure 23C:
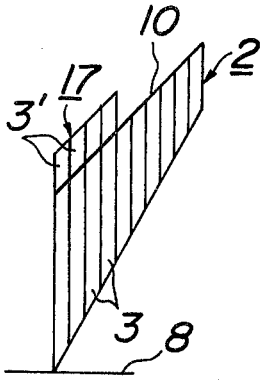

In the embodiment shown in FIG. 23*c*, the inclined angle of the hollow passages 3' of the extension 17 is made equal to the inclined angle of the hollow passages 3 of the control device 2. In the embodiment shown in FIG. 23*d*, the inclined angle of the hollow passages 3' of the extension 17 is made different from the inclined angle of the hollow passages 3 of the control device 2.

Figure 23E:
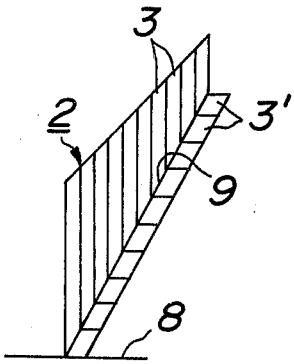
Figure 23D:
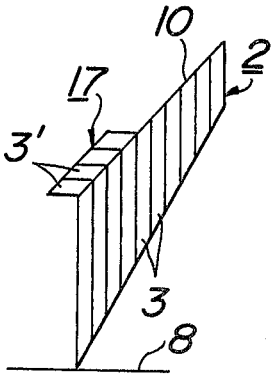

In the embodiment shown in FIG. 23*e* the device 2 is provided at overall part of its lower noise outlet surface 9 with an extension 17 whose hollow passages 3' are inclined from the corresponding hollow passages 3 by right angles.

Figure 24A:
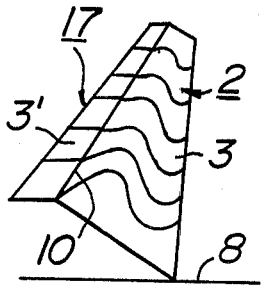

In another embodiment shown in FIG. 24*a*, an extension 17 having a plurality of rectilinear hollow passages 3' is separated from and secured overall to part of the upper noise inlet side surface 10 of a device 2 having corresponding non-linear hollow passages 3.

Figure 24B:
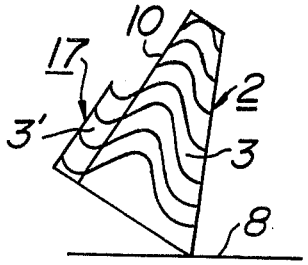

In a further embodiment shown in FIG. 24*b*, an extension 17 having a plurality of non-linear hollow passages 3' is separated from and secured to the lower part of the upper noise inlet side surface 10 of the device 2 having non-linear hollow passages 3 shown in FIG. 24*a*.

The above mentioned arch type device 1 may also be provided at its upper noise inlet side surfaces with extensions of hollow passages.

Figure 25A:
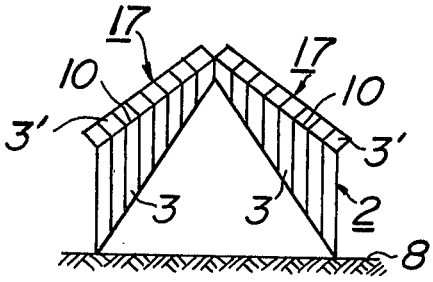

In one embodiment shown in FIG. 25*a*, the arch type device 2 is provided at respective upper noise inlet surfaces 10, 10 thereof with extensions 17, 17 and the hollow passages 3', 3' of these extensions 17, 17 communicate with all of corresponding hollow passages 3, 3 of the control device 2.

Figure 25B:
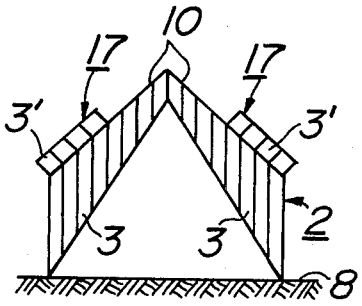
Figure 25C:
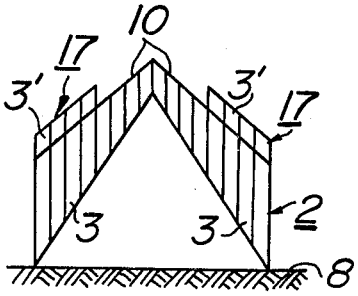

In another embodiments shown in FIGS. 25*b* and 25*c*, the arch type device 2 is provided at respective lower portions of the upper noise inlet surfaces 10 thereof with extensions 17, 17 and the hollow passages 3' of these extentions 17, communicate with several corresponding hollow passages 3 of the device 2. In the embodiments shown in FIGS. 25*a* and 25*b*, the inclined angle of the hollow passages 3' of the extension 17 with respect to the substrate 8 is made different from the inclined angle of the hollow passages 3 of the device 2 with respect to the substrate 8. In the embodiment shown in FIG. 25*c*, the inclined angle of the hollow passages 3' of the extension 17 with respect to the substrate 8 is made equal to the inclined angle of the hollow passages 3 of the device 2 with respect to the substrate 8.

As shown in FIGS. 26*a* and 26*b*, on the substrate 8 was arranged a device 2 according to the invention and in front of the device 2 was arranged a speaker S which is designed to emit noise. The amount of reduced sound was measured at a sound receiving point O. The sound receiving point O is a midpoint between a point N located on an extension drawn from a center axis of the speaker S and a point M located on an extension of a line connecting the speaker S to the upper edge of the device 2.

The device 2 shown in FIG. 26*a* is not provided at its upper noise inlet side surface 10 with an extension 17 of hollow passages, while the device 2 shown in FIG. 26*b* is provided at its upper noise inlet side surface 10 with an extension 17 of hollow passages.

In FIG. 27 the results from the above experimental tests are shown. In FIG. 27, a curve a is plotted from the experimental test on the device 2 with no extension 17 of hollow passages as shown in FIG. 26*a*, while a curve b is plotted from the experimental test on the device 2 with an extension 17 of hollow passages as shown in FIG. 26*b*.

As seen from FIG. 27, the provision of the extension 17 of hollow passages ensures an increase of the amount of reduced sound. Particularly, the amount of reduced sound is significantly improved over a low frequency range of lower than 500 Hz.

As explained hereinbefore, the use of an extension of hollow passages ensures an improvement of the sound reducing effect of the device and provides an efficient measure for insulating sound.

As seen from the above, a principal feature of the invention is the provision of a plurality of elongated vertical hollow passages 3 each formed between two adjacent vertically extending partition walls 11 spaced apart from each other, at least one part of the hollow passages 3 being separated from the substrate 8 and located above the substrate 8. As a result, a part of noise emitted from the noise source 1 is refracted when passed through the elongated vertical hollow passages 3 and lags in phase with respect to a direct sound propagation emitted from the noise source 1 and passed over the upper edge of the control device 2 and the refracted sound propagation is interfered with the direct sound propagation to produce a sound reducing region located intermediate between the direct sound propagation and the refraction sound propagation. As a result, it is possible to significantly improve the sound reducing effect of the sound insulating wall associated with the device according to the invention.

Heretofore, it has been the common practice to directly propagate the noise emitted from the noise source 1 toward the sound insulating wall 5, so that the amount of noise passed over the sound insulating wall 5 becomes large. On the contrary, the use of the device according to the invention ensures a significant reduction of the amount of noise passed over the sound insulating wall 5.

As explained hereinbefore, the use of the device for controlling propagation direction of noise according to the invention ensures a refraction of the noise propagation direction and at the same time a lag in phase thereof with respect to the direct sound propagation passed over the upper edge of the device and further provides the important advantage that a destructive interference phenomenon occurs to produce a sound reducing region located between the direct sound propagation and the refraction sound propagation. If the device according to the invention is combined with the sound insulating wall disposed on a substrate such as an elevated railroad, highway and the like it is possible to effectively improve the sound reducing effect of the sound insulating wall. In addition, if the refractive power of the device is made large, it is possible to make the height of the sound insulating wall low and eventually omit it when the refraction sound propagation is absorbed by a sound absorbing material.

As seen from the above, the device according to the invention is simple in construction, can be used as a device for significantly reduce the noise and contributes greatly to the industry.

What is claimed is:

1. A device for controlling a propagation direction of noise, comprising a hollow structural body composed of a plurality of elongated hollow passages, said hollow passages being arranged at right angles to a substrate and having upper and lower ends open to the atmosphere, two adjacent hollow passages being different in length and at least one part of said hollow passages being separated from the substrate, the other part being located substantially on the substrate, and said hollow structural body being provided at its lower portion with a space freely communicating with the outside of said hollow structural body, whereby a part of noise emitted and propagated from a noise source is refracted and lags in phase when passed through said hollow passages and the refracted sound is interfered with a direct sound propagation passing over the upper edge of the hollow passages to produce a sound reducing region intermediate between the direct sound propagation and the refraction sound propagation.

2. A device according to claim 1, wherein the upper noise inlet side surface of said plurality of hollow passages is inclined upwardly from the propagation direction of noise or the substrate by an angle $\beta$ and the lower noise outlet side surface of said plurality of hollow passages is inclined from the substrate by an angle $\alpha$, the angle $\beta$ being within a range between 15° and 50°.

3. A device according to claim 1, wherein the maximum length L of said elongated hollow passages is defined to a length which is longer than ½ times the wave length $\lambda$ of the minimum frequency f in that frequency range of noise emitted from a noise source which is to be controlled.

4. A device according to claim 1, wherein said plurality of elongated hollow passages are of random cross sectional configurations extending vertically parallel to each other.

5. A device according to claim 4, wherein said plurality of elongated vertical hollow passages are arranged in a random distribution to said noise source.

6. A device according to claim 1, wherein each cross sectional area of said elongated hollow passages enlarges from its upper noise inlet side surface toward its lower noise outlet side surface.

7. A device according to claim 1, wherein said device is arranged between a noise source and a sound insulating wall and the height of the device is made at least equal to a line connecting said noise source to the front upper edge of said sound insulating wall.

8. A device according to claim 1, wherein a pair of said devices are arranged on a substrate with respective upper end surfaces abutted against each other to form an arch type device.

9. A device according to claim 1, wherein said plurality of elongated hollow vertical passages are formed by a number of honeycomb-shaped square elongated hollow vertical passages.

10. A device according to claim 1, wherein said plurality of elongated hollow vertical passages are provided at their upper or lower ends with an extension of corresponding elongated hollow passages which are made integral and communicated with said hollow vertical passages.

11. A device according to claim 1, wherein said plurality of elongated hollow passages are provided at their upper or lower ends with an extension of corresponding hollow passages which are secured to said hollow passages and communicate therewith.

* * * * *